United States Patent [19]

Hotta

[11] 4,287,943

[45] Sep. 8, 1981

[54] HEAT INSULATING BOX

[75] Inventor: Masashi Hotta, Osaka, Japan

[73] Assignee: Shimano Industrial Company, Limited, Osaka, Japan

[21] Appl. No.: 52,735

[22] Filed: Jun. 28, 1979

[30] Foreign Application Priority Data

Jul. 5, 1978 [JP] Japan ..... 53-93314
Jul. 5, 1978 [JP] Japan ..... 53-93315

[51] Int. Cl.[3] ..... F28D 21/00; F25D 3/08

[52] U.S. Cl. ..... 165/104.19; 62/457; 126/400

[58] Field of Search ..... 165/104 S; 62/457; 126/400

[56] References Cited

U.S. PATENT DOCUMENTS

| | | | |
|---|---|---|---|
| 1,369,367 | 2/1921 | Thomson | 62/457 X |
| 2,215,274 | 9/1940 | Peterson | 62/457 |
| 2,496,296 | 2/1950 | Lobl | 62/457 X |
| 3,802,220 | 4/1974 | Pompo | 62/457 X |
| 3,807,194 | 4/1974 | Bond | 62/457 |
| 4,145,895 | 3/1979 | Hjertstrand et al. | 62/457 X |

FOREIGN PATENT DOCUMENTS

| | | | |
|---|---|---|---|
| 246737 | 2/1961 | Australia | 62/457 |
| 1266787 | 6/1961 | France | 62/457 |
| 511685 | 8/1939 | United Kingdom | 62/457 |

*Primary Examiner*—Albert W. Davis
*Attorney, Agent, or Firm*—Stevens, Davis, Miller & Mosher

[57] ABSTRACT

A heat insulating box comprises a body and lid of adiabatic construction, and at least one radiator housed within a space between the body and the lid and providing a heat insulating space. The radiator is filled with a high temperature liquid, such as hot water, which liquid serves as a heat source to heat and keep warm the contents, such as lunch, within the heat insulating space, so that the contents may be kept at a desired temperature for a prolonged period of time.

4 Claims, 15 Drawing Figures

HEAT INSULATING BOX

This invention relates to a heat insulating box for keeping objects warm, such as lunch or nursing bottles, by using as a heat source a radiator containing high temperature liquid, such as hot water.

Conventionally, a vacuum flask containing high temperature liquid and a so-called lunch jar, have been proposed for housing and heat insulating foodstaffs. The vacuum flask is constituted of an inner glass tube case and an outer case of synthetic resin with a vacuum formed therebetween. The jar container has a body formed of a heat insulator, such as foaming styrol or glass wool.

The vacuum flask is expensive to produce and it is breakable. The jar container which has an adiabatic construction is deficient in that the temperature of the contents to be kept warm drops quickly making it difficult to keep the contents warm for more than 3 to 4 hours.

The vacuum flask is also larger in volume and because it is breakable is inconvenient to carry. Furthermore, the vacuum flask, like the jar container, has the single function of keeping the contents warm by reducing heat radiation therefrom.

This invention has been designed to overcome the above problems associated with conventional food containers. An object of the invention is to provide a heat insulating box capable of positively heating the contents which are to be kept warm for a prolonged time period and which is portable without fear of breakage, thereby being useable for a long period.

The heat insulating box of the invention comprises a body and lid of adiabatic construction, and at least one radiator housed within a space between the body and the lid and forming a heat insulating space. The radiator is filled with high temperature liquid, such as hot water, and is used as a heat source to heat and keep warm the contents, such as lunch, within the heat insulating space, thereby keeping the contents at a desired temperature for a long time.

In other words, the heat insulating box of the invention has a radiator of sufficient heat capacity which when combined with the box body and lid keep the contents positively heated to slow down the temperature-fall thereof. As a result, the contents can be kept warm for a longer period than with conventional containers. The box is also convenient, portable and unbreakable.

Figure 1:
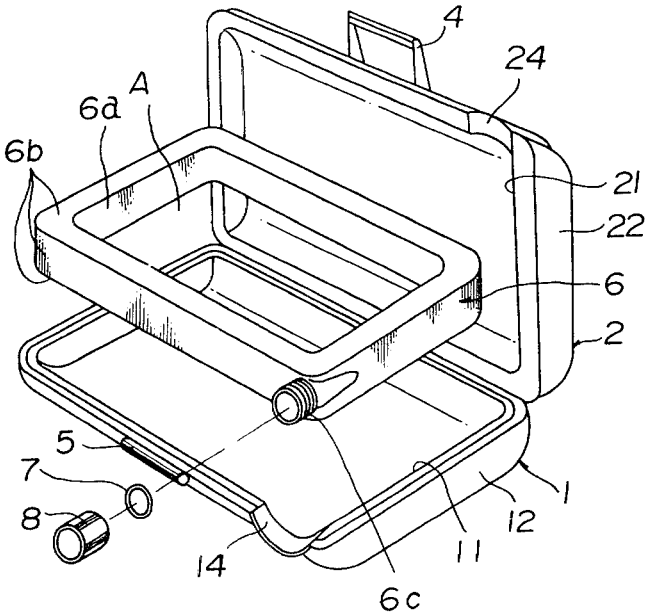
Figure 2:
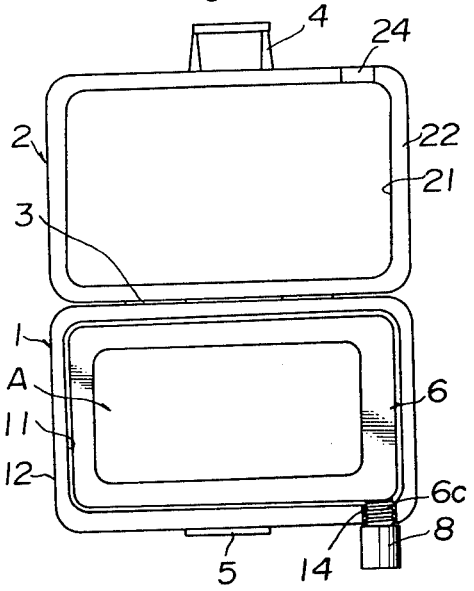
Figure 3:
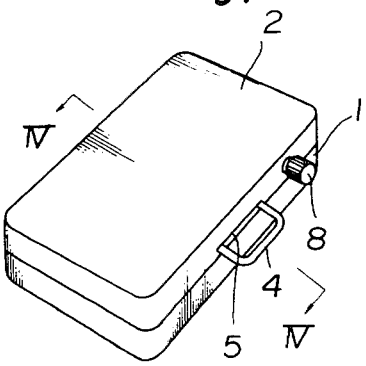
Figure 4:
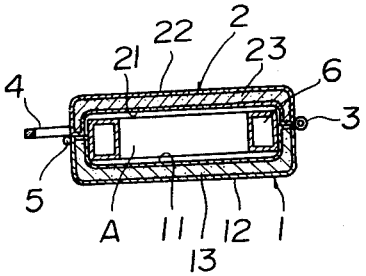
Figure 5:
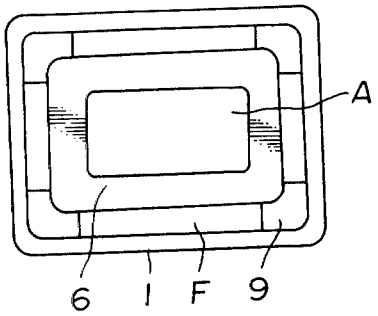
Figure 6:
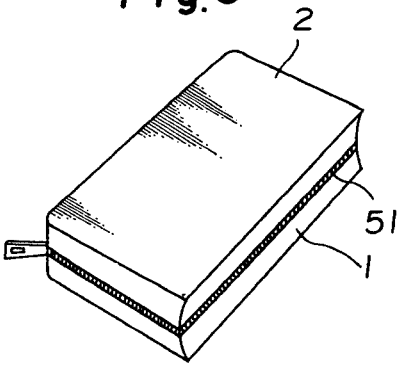
Figure 7:
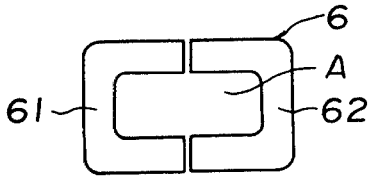
Figure 8:
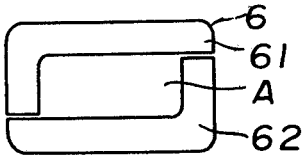
Figure 9:
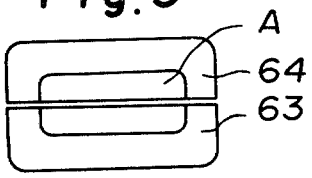
Figure 10:
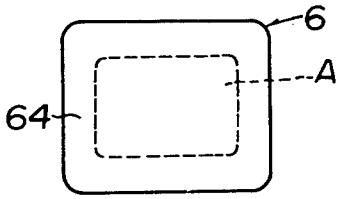
Figure 11:
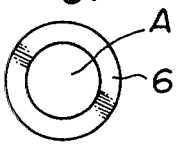
Figure 12:
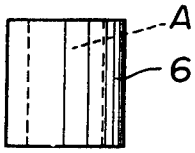
Figure 13:
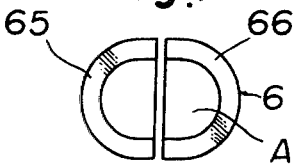
Figure 14:
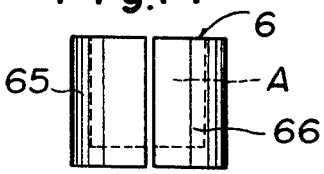
Figure 15:
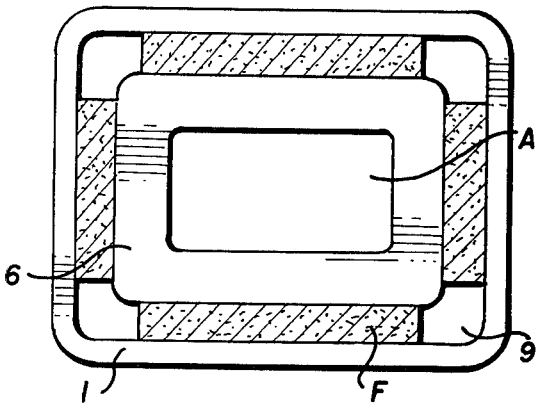

These and other objects and novel features of the invention will be apparent from the following description of embodiments thereof taken in accordance with the accompanying drawings, in which:

FIG. 1 is a perspective view of an embodiment of the heat insulating box of the invention, FIG. 2 is a plan view thereof with an open lid, FIG. 3 is a perspective view of the box with a closed lid, FIG. 4 is a schematic sectional view taken on Line IV—IV in FIG. 3, FIG. 5 is a plan view of a modified embodiment having a radiator smaller than the box body, in which a the lid is omitted, FIG. 6 is a perspective view of another type of box body lid, FIGS. 7 through 14 illustrate a radiator only, in which FIGS. 7, 8, 11, and 13 are respective plan views of a pair of C-shaped radiators, a pair of L-shaped radiators, a cylindrical radiator and a pair of cylindrical L-shaped radiators thereof, FIG. 9 is a sectional side view a pair of recessed radiators, FIG. 10 is a plan view of the radiator of FIG. 9, FIG. 12 is a side view of the radiator in FIG. 11, FIG. 14 is a side view of the radiator in FIG. 13, and FIG. 15 is a plan view similar to FIG. 5, but showing use of a heat accumulator.

Referring to the drawings, reference numeral 1 designates a box body having an upwardly directed opening, and reference numeral 2 denotes a lid for closing the upper opening of the box body 1 and forming a space enclosed and sealed between the lid 2 and the body 1.

The box body 1 comprises an inner case 11 and outer case 12 each having a box-like shape formed mainly of synthetic resin of a heat resistant, such as polypropylene. Between the inner case 11 and the outer case 12 is inserted a heat insulator 13, such as a foaming styrol resin. The cases 11 and 12 are connected to form an adiabatic construction.

The lid 2 comprises an inner case 21 and an outer case 22, which are connected through heat insulator 23 inserted therebetween, and is formed in an adiabatic construction. The lid 2 also is supported to the body 1 in a manner permitting free opening and closing through fittings 3, such as hinges. The lid 2 closes the body 1 to keep the box airtight.

A handle 4 is attached to the lid 2. At the body 1 and lid 2 are mounted a lock fitting 5 and a fastener 51 as shown in FIG. 6.

Reference numeral 6 designates a radiator which is housed within the space between the box body 1 and the lid 2. The radiator 6 is made from a heat resistant synthetic resin, such as polypropylene, or a heat resistant metal. The radiator 6 is formed in a frame having enough of a hollow to ensure a heat insulating space, and a high temperature liquid, such as hot water or tea, is contained within the hollow. The radiator 6 is housed within the box body 1 and lid 2 to form a heat insulating space A surrounded by the radiator. The space A provides a place for storing food contents, such as lunch, which are to be kept warm, and the high temperature liquid provided within the radiator 6 serves as a heat source to heat and keep warm the contents.

The radiator 6 has an intake **6*c* for liquid. A cap 8 has therein a packing 7 of heat resistant synthetic rubber such as silicon rubber. The cap 8 is screwed with the intake 6*c* through a female screw at the inner periphery of the former and a male screw at the outer periphery of the latter, so that liquid may not leak through the intake 6*c***.

The heat radiation surface **6*a* of radiator 6 facing the heat insulating space A is preferably formed of a metal, such as stainless steel or aluminum, having good heat transfer characteristics. Three other surfaces in contact with the box body 1 and lid 2 are preferably provided with a lining of glass wool or of cloth-containing resin having a poor heat transfer characteristic to thereby form the surfaces 6*b* for preventing heat radiation. The radiator 6 may, other than having the frame-like shaped shown in FIGS. 1 and 2, be formed as shown in FIGS. 7 to 14. The radiator shown in FIGS. 11 and 12 has a cylindrical shape, and those shown in FIGS. 7 to 10 and 13 and 14**, are paired respectively and the paired radiators are frame-like, box-like, and cylindrically shaped.

Referring to FIGS. 7 and 8, a first and a second radiator 61 and 62 are each formed in a U-like shape in plane figure and are arranged in a frame similarly to FIGS. 1 and 2 so that the heat insulating space A is formed by being surrounded by the two radiators 61 and 62.

Referring to FIGS. 9 and 10, a third radiator 63 of a boxlike shape upwardly recessed at a central portion thereof and a fourth radiator 64 of a box-like shape and downwardly recessed at a central portion thereof are combined to form the heat insulating space surrounded at all sides by walls of radiators 63 and 64.

Referring to FIGS. 13 and 14, a fifth radiator 65 and a sixth radiator 66 are L-like shaped in side section as shown in FIG. 14 and combined to form in a cylindrical shape at the bottom, so that the heat insulating space A is formed which is surrounded by both the radiators 65 and 66.

In addition, the pair of radiators, which are combined as aforegoing, are each provided with an intake (not shown in FIGS. 7 to 14) similar to that in FIGS. 1 and 2, the intake being closed by a cap screwed therewith.

It is preferable that the intake 6*c*, which projects from the radiator 6, projects at the screw-threaded portion out of the body 1 and lid 2 through concavities 14 and 24 provided at the body 1 and lid 2 respectively as shown in FIGS. 1 and 2. By this, high temperature liquid can be fed into or discharged from the radiator 6 when the lid 2 is closed.

Referring to FIG. 5, the radiator 6 is made considerably smaller than the box body 1 so that a space F is formed between the body 1 and the radiator 6. Hence, air in the space F serves as a heat accumulator to improve the heat insulation effect. In addition, in FIG. 5, reference numeral 9 designates supports for the radiator 6. In the construction shown in FIG. 5, the space F may be occupied by a heat insulator of foaming styrol or a heat accumulator of bubbly rubber may be used as illustrated in FIG. 15. Or, another radiator a size larger than the frame-like radiator 6 may be formed to occupy the space F.

When the radiator 6 is frame-like or cylindrically shaped as shown in FIGS. 1, 2 and 5 or 11 and 12, or when two radiators are combined to be formed in a frame-like shape as shown in FIGS. 7 and 8, other flat radiators can be combined with the upper and lower surfaces of the radiator 6.

As clearly understood from the aforesaid description, the heat insulating box of the invention houses within the body thereof a radiator which surrounds the heat insulating space A, so that the contents are heated and kept warm by use of the heat source of high temperature liquid filled in the radiator. Hence, for example, at an external temperature of 5° to 10° C., when the radiator is filled with hot water at 100° C., the contents to be kept warm at an initial temperature of 90° C. can be kept at a temperature of 60° C. to 70° C. even after six hours, thereby making it possible to preserve heat for longer periods in comparison with a conventional heat insulating container.

Furthermore, the box of the invention is simple in construction and inexpensive to produce, and, unlike the vacuum flask, is convenient, portable and unbreakable.

Also, the high temperature liquid heat source, such as hot water or tea, can be used for drinking purposes.

In addition, the various types of radiators in the embodiments shown and described can be used to keep warm the contents of lunch boxes or nursing bottles. The pair of radiators can be combined, or one radiator can be separated by partitions, so that various high temperature liquids, e.g., tea, and soups, may be contained together and kept warm.

While several embodiments of the invention have been shown and described, the invention is not limited thereto as many modifications can be made thereto without departing from the spirit and scope of the invention which is defined in the following claims.

What is claimed is:

1. An insulating box comprising a box body having an opening, a lid hingedly supported to said box body for closing said opening to form a space between said lid and said box body, releasable means for retaining said lid closed over said opening, and a radiator housed within said space, said box body and lid having an adiabatic construction, said radiator being smaller in size than said space so that when said radiator is housed within said space, a temperature retention space is defined by said radiator, box body and lid for keeping objects therein at a constant temperature, said radiator comprising a hollow and sealed container of heat resistant material having an intake for liquid and a cap closing said intake, and having a frame-like shape encircling said temperature retention space, said radiator intake projecting through an opening of said box body such that said cap is accessable from the exterior of said body.

2. An insulating box according to claim 1, wherein an adiabatic space is provided between the outer surface of said frame-like shape radiator and the inner surface of said box body.

3. An insulating box according to claim 2, wherein said adiabatic space is filled with heat accumulation material.

4. An insulating box according to claim 1, wherein the surface of said radiator opposite to said heat insulating space is formed of material having better heat transfer characteristics than other surfaces of said radiator.

* * * * *